United States Patent [19]

Kun et al.

[11] Patent Number: 5,043,631

[45] **Date of Patent: * Aug. 27, 1991**

[54] THIN FILM ELECTROLUMINESCENT EDGE EMITTER STRUCTURE ON A SILICON SUBSTRATE

[75] Inventors: Zoltan K. Kun, Churchill Boro; Michael W. Cresswell, Plum Boro; Richard H. Hopkins, Murrysville Boro, all of Pa.

[73] Assignee: Westinghouse Electric Corp., Pittsburgh, Pa.

[ * ] Notice: The portion of the term of this patent subsequent to Apr. 2, 2008 has been disclaimed.

[21] Appl. No.: 235,143

[22] Filed: Aug. 23, 1988

[51] Int. Cl.[5] ..... G09G 3/10; H01J 1/62

[52] U.S. Cl. ..... 315/169.3; 340/760; 340/781; 340/825.81; 313/509; 428/917

[58] Field of Search ..... 315/169.3; 340/760, 340/781, 782, 825.81; 357/17, 19, 40; 313/509; 428/917

[56] References Cited

U.S. PATENT DOCUMENTS

| | | | |
|---|---|---|---|
| 3,141,107 | 7/1964 | Wasserman | 315/169.3 |
| 3,246,162 | 4/1966 | Chin | 357/17 |
| 3,387,271 | 6/1968 | Chernow | 315/169.3 |
| 3,701,123 | 10/1972 | Barrett et al. | 315/169.3 |
| 3,771,217 | 11/1973 | Hartman | 357/40 |
| 3,854,070 | 12/1974 | Vlasenko et al. | 313/509 |
| 3,867,666 | 2/1975 | Nyul | 357/17 |
| 3,942,185 | 3/1976 | Lebailly | 357/17 |
| 3,974,514 | 8/1976 | Kressel et al. | 357/17 |
| 3,975,661 | 8/1976 | Kanatani et al. | 357/17 |
| 4,006,383 | 2/1977 | Luo et al. | 315/169.3 |
| 4,079,404 | 3/1978 | Comerford et al. | 357/17 |
| 4,103,208 | 7/1978 | Washizuka | 315/169.3 |
| 4,110,664 | 8/1978 | Asars et al. | 315/169.3 |
| 4,301,451 | 11/1981 | Barta | 315/169.3 |
| 4,464,602 | 8/1984 | Murphy | 313/509 |
| 4,535,341 | 8/1985 | Kun et al. | 346/107 R |
| 4,590,128 | 5/1986 | Kawai | 428/411.1 |
| 4,847,665 | 7/1989 | Mand | 357/19 |
| 4,859,904 | 8/1989 | Higton et al. | 313/509 |

OTHER PUBLICATIONS

"Output Coupling Efficiency of a One-D Array of Light Emitters", J. Shmulovich & J. S. Patel, Applied Optics, Vol. 25, No. 13 (Jul. 1, 1988).

"Growth of Crystalline Zinc Sulfide Films On A (111)-Oriented Silicon Molecular-Beam Epitaxy", Meiso, Yokoyama and Shin-Ichi Ohta, Journal of Applied Physics 59 (11), (Jun. 1, 1986).

"High Quality Zinc Sulfide Epitaxial Layers Grown on (100) Silicon by Molecular Beam Epitaxy", Meiso, Yokoyama, Ko-Ichi, Kashiro and Shin-Ichi Ohta, Applied Physics Letters, Vol. 49, No. 7, (Aug. 18, 1986).

*Primary Examiner*—Eugene R. Laroche
*Assistant Examiner*—Michael Shingleton
*Attorney, Agent, or Firm*—D. G. Maire

[57] ABSTRACT

A thin film electroluminescent edge emitter assembly includes a substrate layer having a configuration to define at least one lateral edge surface and at least one integrated circuit formed therein. The integrated circuit has an input for receiving logic signals, and has an excitation voltage input and a plurality of output leads. The output leads form control electrodes each having an end portion terminating at the substrate lateral edge surface. The integrated circuit is operable to provide an excitation voltage to selected control electrodes in response to preselected logic signals provided to the integrated circuit at the logic signal input.

A laminar arrangement formed from a first dielectric layer, a second dielectric layer, a phosphor layer interposed between the first and second dielectric layers and a common electrode layer is disposed on the end portions of the control electrodes. These various layers define a plurality of pixels each having a light-emitting face at the substrate lateral edge surface. Pixels associated with the selected control electrodes are responsive to the excitation voltage provided to the selected control electrodes to radiate a light signal emitted at the pixel light emitting faces.

11 Claims, 2 Drawing Sheets

THIN FILM ELECTROLUMINESCENT EDGE EMITTER STRUCTURE ON A SILICON SUBSTRATE

BACKGROUND OF THE INVENTION

1. Field of the Invention

This invention relates generally to an electronically controlled high resolution light source, and more particularly, to a thin film electroluminescent edge emitter structure arranged to provide a linear array of individual light-emitting pixels and positioned on a silicon substrate having formed therein an electronic power-switching network which is operable to control the illumination of the various pixels forming the array.

2. Background Information

The use of electronically controlled, high resolution light sources is well known. For example, light-activated printers capable of high resolution (e.g. 240 to 1000 dots per inch) are presently available which utilize a laser as the high resolution light source. Such printers are more versatile than impact printers and can, for instance, print different type styles and sizes at any time, under electronic control.

It is also known to utilize electroluminescent of this type of application is disclosed in U.S. Pat. No. 4,110,664 to Asars et al. which is assigned to the assignee of the present invention. The flat panel display device of the above-identified patent is an electroluminescent bar graph display system which includes, on a unitary substrate, a plurality of discrete, individually controllable adjacent electroluminescent display elements interconnected to a thin film transistor dynamic shift register. Individual stages of the shift register are connected to individual display elements. The electroluminescent display element utilized in such a system is of the type in which one of the electrodes for use with the electroluminescent phosphor is a common light transmissive member. This common electrode is contiguous with the device face and the emissions must pass through this electrode.

The structure of such a display panel may also be seen in U.S. Pat. No. 4,006,383 to Luo et al. which is also assigned to the assignee of the present invention. The Luo et al. patent discloses an electroluminescent display panel structure in which individual electroluminescent electrodes cover a large are of the panel in order to increase the active display area. The face of the electroluminescent element is the display surface electrode.

Another example of an electronically controlled, high resolution light source is disclosed in U.S. Pat. No. 4,535,341 to Kun et al., which is assigned to the assignee of the present invention. This patent discloses a thin film electroluminescent line array emitter structure which provides edge emissions which are typically 30 to 40 times brighter than the face emissions of conventional flat panel display light sources. In one embodiment of the invention, the emitter structure includes an integral capacitor in series with each emitter structure pixel. This integral thin film structure dielectric and phosphor composite layer serves as both the light-emitting layer for the edge emitting device and the dielectric for the capacitor.

While the prior art discloses various thin film electroluminescent devices, there is a need for a thin film electroluminescent (TFEL) edge emitter structure which is disposed on a layer of substrate material and connected with one or more integrated circuits formed in the substrate layer. The thin film electroluminescent (TFEL) edge emitter structure and substrate layer form a thin film electroluminescent (TFEL) edge emitter assembly wherein the integrated circuits provide a power-switching function to control the illumination of the individual pixels of the TFEL structure. Forming the pixel illumination control circuitry within the substrate layer eliminates the need for an external pixel illumination control system; thus providing a thin film electroluminescent edge emitter assembly which is both inexpensive and relatively easy to manufacture.

SUMMARY OF THE INVENTION

In accordance with the present invention, there is provided a thin film electroluminescent edge emitter assembly which includes a substrate having a configuration to define at least one lateral edge surface and having at least one integrated circuit formed therein. The integrated circuit has a logic signal input, an excitation voltage input and a plurality of output leads. Each of the output leads forms a control electrode having an end portion which terminates substantially at the substrate lateral edge surface. Means internal to the integrated circuit provides an excitation voltage from the excitation voltage input to selected control electrodes in response to preselected logic signals provided to the integrated circuit at the logic signal input.

A first dielectric layer is disposed on the plurality of control electrodes at the control electrodes end portions. A second dielectric layer is spaced from the first dielectric layer, and a phosphor layer is interposed between the first and second dielectric layers. A common electrode layer is disposed on the second dielectric layer. The plurality of control electrodes, first and second dielectric layers, phosphor layer and common electrode layer define a structure forming a plurality of pixels each having a light emitting face at the substrate lateral edge surface. Selected pixels are responsive to the excitation voltage provided to the selected control electrodes to generate a light signal which is emitted at the selected pixels light emitting faces.

Further in accordance with the present invention, there is provided a method for forming a thin film electroluminescent edge emitter assembly including the steps of providing a substrate having a configuration to define at least one lateral edge surface, and forming in the substrate at least one integrated circuit having a logic signal input, an excitation voltage input and a plurality of output leads. Each of the output leads forms a control electrode having an end portion terminating substantially at the substrate lateral edge surface. The method includes the further step of providing means internal to the integrated circuit for providing an excitation voltage from the excitation voltage input to selected control electrodes in response to preselected logic signals received at the logic signal input. A laminar arrangement formed from a first dielectric layer, a second dielectric layer, a phosphor layer interposed between the first and second dielectric layers and a common electrode layer is disposed on the control electrodes end portions with the first dielectric layer contacting the end portions. The laminar arrangement and the end portions define a structure forming a plurality of pixels each having a light emitting face at the control electrodes end portions. The method further includes the step of providing an excitation voltage to the selected control electrodes to generate within selected pixels a light signal emitted at the selected pixels light emitting faces.

BRIEF DESCRIPTION OF THE DRAWINGS

The above as well as other features and advantages of the present invention will become apparent through consideration of the detailed description in connection with the accompanying drawings in which.

DESCRIPTION OF THE PREFERRED EMBODIMENT

The present invention is a thin film electroluminescent (TFEL) line array or edge emitter assembly which is utilized as a solid state, electronically-controlled high resolution light source. The assembly is formed from a thin film electroluminescent edge emitter structure disposed on a layer of substrate material. The electronic control for the TFEL assembly is provided from an electronic power-switching network formed in the substrate layer upon which the TFEL structure is disposed. The inventors have discovered that positioning the TFEL structure on a substrate layer having a power-switching network embedded therein, and utilizing the power-switching network to control the illumination of the individual pixels forming the TFEL structure not only eliminates the external pixel illumination control circuitry required of prior art TFEL devices, but also provides a high resolution light source which is both inexpensive and relatively easy to manufacture.

Figure 1:
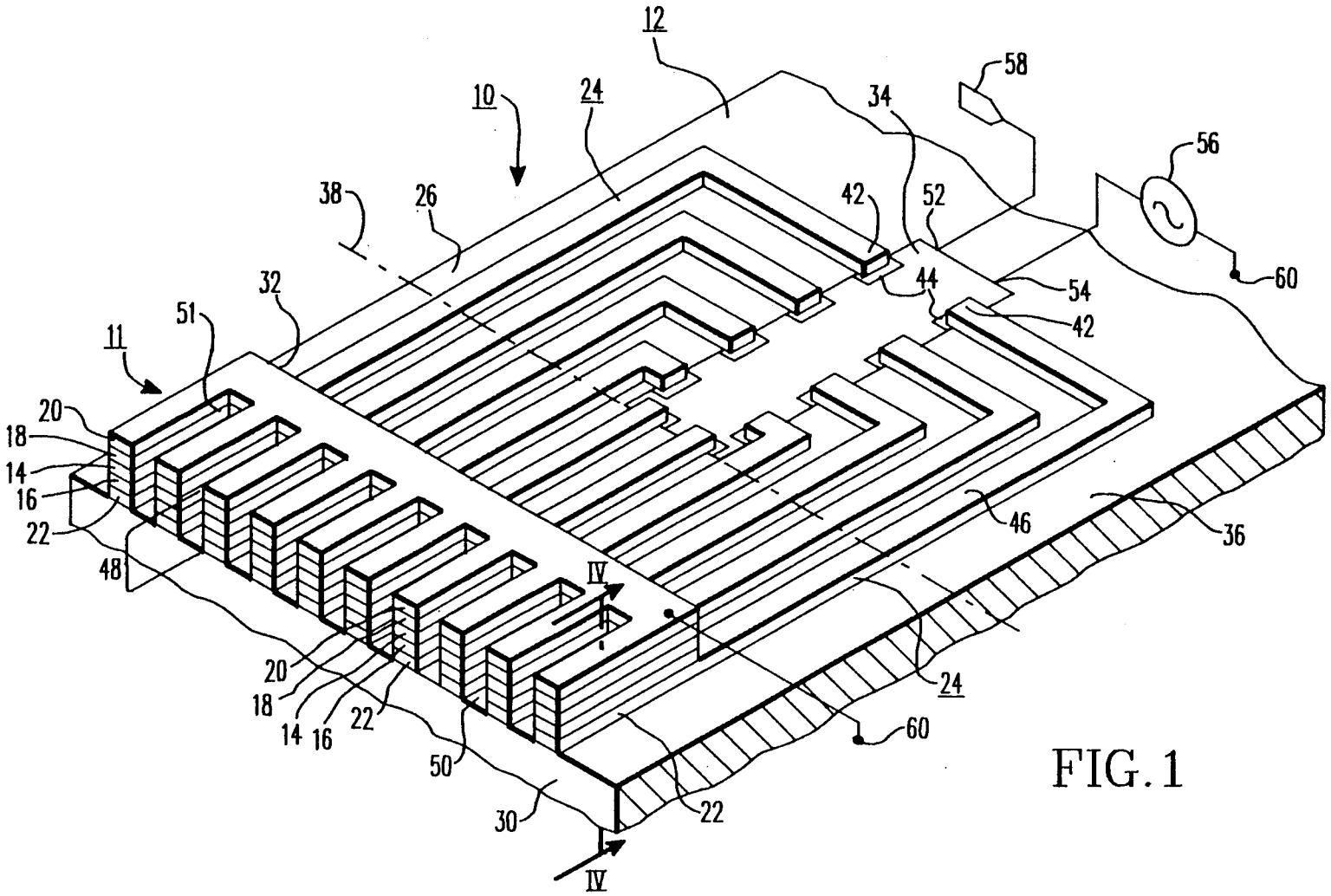
FIG. 1 is a perspective view of the thin film electroluminescent edge emitter assembly of the present invention.
Figure 2:
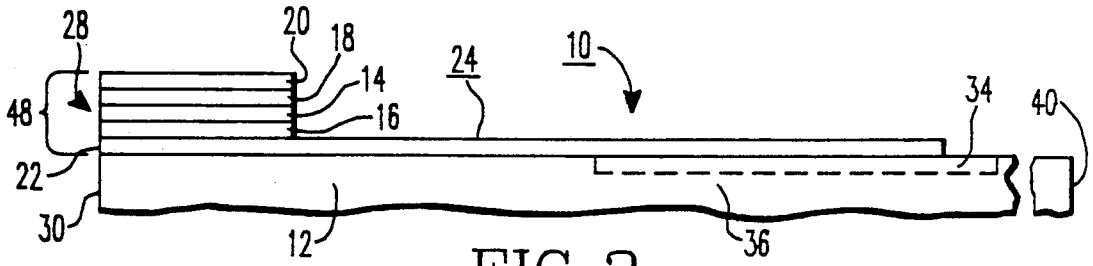
FIG. 2 is a view in side elevation of the thin film electroluminescent edge emitter assembly of the present invention.

The basic structure of the thin film electroluminescent (TFEL) line array or edge emitter assembly of the present invention is illustrated in FIG. 1, and is generally designed by the reference numeral 10. TFEL assembly 10 includes a thin film electroluminescent edge emitter structure 11 disposed on a substrate layer 12. As will be explained later in greater detail, substrate layer 12 includes an electronic power-switching network formed therein which is connected with the edge emitter structure 11 via a plurality of control electrodes. The power-switching network is operable to provide to TFEL structure 11 on a selective basis preselected control signals for illuminating the plurality of pixels formed in the structure.

Figure 4:
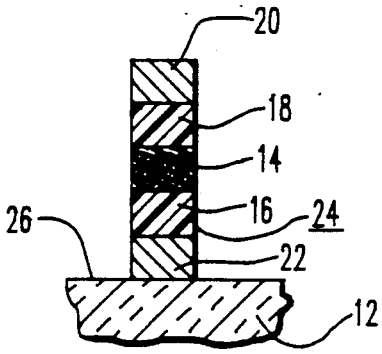
FIG. 4 is a view taken along line IV—IV of FIG. 1, illustrating the various dielectric, phosphor and electrode layers forming an individual pixel of the thin film electroluminescent structure.

As seen in FIG. 1, TFEL structure 11 includes a phosphor layer 14 interposed between a first dielectric layer 16 and a second dielectric layer 18. A common electrode layer 20 is disposed on second dielectric layer 18. As described, first dielectric layer 16, phosphor layer 14, second dielectric layer 18 and common electrode layer 20 are arranged in a generally laminar configuration. This laminar configuration is illustrated in further detail in FIG: 4, which is a view taken along line IV—IV of FIG. 1. As seen in FIG. 4, phosphor layer 14 is interposed between first and second dielectric layers 16, 18 and common electrode layer 20 is disposed on second dielectric layer 18. It should be pointed out that although first and second dielectric layers 16, 18 are illustrated in the Figures as unitary layers, each dielectric layer may in fact consist of a plurality of sublayers. In addition, the sublayers may be formed from different dielectric materials, and those skilled in the art may select the sublayer material utilized depending upon the dielectric properties desired. As seen in FIGS. 1 and 4, TFEL structure 11 formed from phosphor layer 14, first and second dielectric layers 16, 18, and common electrode layer 20, is disposed on the end portions 22 of a plurality of control electrodes 24, which are formed on the top surface 26 of substrate layer 12 in laterally spaced and generally parallel relationship to one another. As will be explained later in greater detail, the plurality of control electrodes 24 are utilized to provide an excitation voltage from the power-switching network formed in the substrate to the plurality of pixels of TFEL structure 11. Thus, it should be understood that the end portions 22 of the laterally-spaced control electrodes 24 in contact with the first dielectric layer 16 also form a portion of TFEL structure 11.

Both first and second dielectric layers 16, 18 may be formed from a single layer of yttrium oxide $Y_2O_3$ material, having a thickness of approximately 2000 Å. As previously stated, both first and second dielectric layers 16, 18 may be formed from a plurality of sublayers if desired. Phosphor layer 14 is formed from a ZnS:Mn material having a thickness of approximately 10,000 Å. The composition of the electroluminescent phosphor source material is preferably selected to produce a structure having luminescence characteristics favorable for line array emitter applications; specifically, fast luminescence decay permitting a rapid refresh rate. Common electrode layer 20 may be formed from any suitable metal, such as an aluminum film. The phosphor layer 14, dielectric layers 16 and 18, common electrode 20 and control electrodes 24 of the TFEL structure 11 are formed by any suitable conventional technique, such as E-beam evaporation and photolithography.

TFEL structure 11 includes an edge face 28 which is the emission source or light-emitting face. Light-emitting face 28 is aligned with the lateral edge surface 30 of substrate layer 12. TFEL structure 11 also includes a rear edge face 32 opposite light-emitting edge face 28. As will be explained later in greater detail, the specific construction of TFEL structure 11 provides that substantially all of the light generated by the plurality of pixels formed in structure 11 is emitted only at light-emitting edge face 28 and practically none of the generated light is emitted at rear edge face 32.

Figure 3:
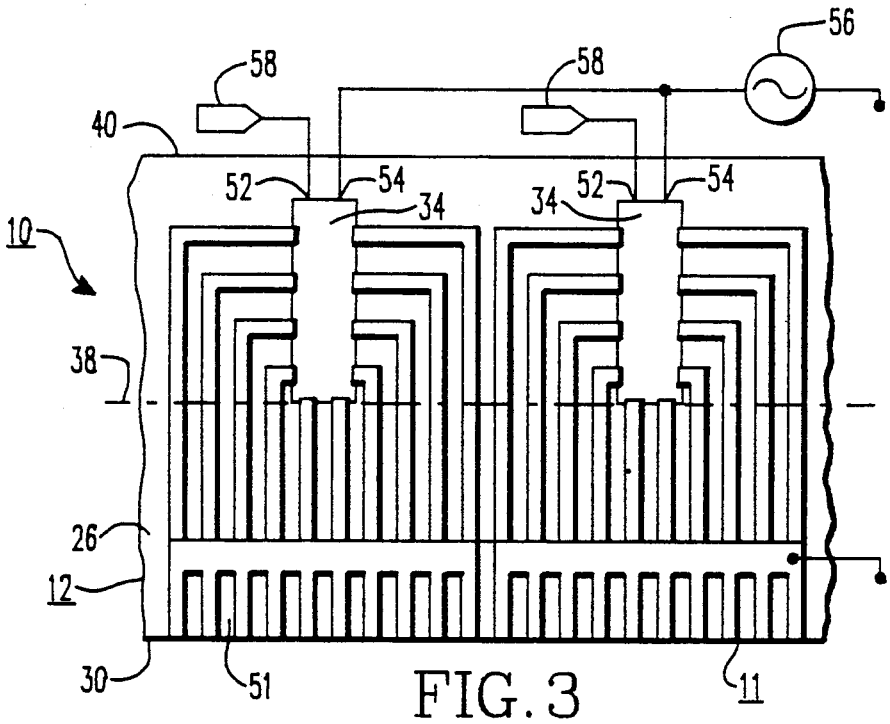
FIG. 3 is a top view of a pair of integrated circuits formed in a layer of substrate material, illustrating a thin film electroluminescent structure disposed on the ends of the output leads of the integrated circuits.

Now referring to FIGS. 1 and 3, TFEL structure 11 is positioned on the top surface 26 of substrate layer 12 so that light-emitting edge face 28 is aligned with lateral edge surface 30. TFEL structure 11 is disposed on the end portions 22 of a plurality of control electrodes 24 (the end portions also forming a portion of the structure) which extend between an electronic power-switching network formed from at least one integrated circuit 34 and the lateral edge surface 30 of substrate layer 12. Although one integrated circuit 34 is illustrated in FIG. 1 and a pair of integrated circuits 34 are illustrated in FIG. 3, it should be understood that any number of integrated circuits 34 may be utilized depending upon the overall length of light emitting face 28 lying along lateral edge surface 30 and the total number of pixels to be formed.

Substrate layer 12 is preferably made from a silicon material, and each of the integrated circuits 34 illustrated in FIGS. 1 and 3 is formed in the interior portion 36 of substrate layer 12 utilizing known integrated circuit fabrication techniques. Substrate layer 12 may be formed from a sheet-like layer of silicon ribbon, such as described in U.S. Pat. No. 3,129,061 and assigned to the assignee of the present invention. If a silicon ribbon is utilized, it may be cut to a desired length. This allows the required number of integrated circuits 34 to be formed in the interior portion 36 of substrate layer 12 depending upon the total number of pixels required for a particular application. Although the use of a silicon ribbon is described herein, it is contemplated that, within the scope of this invention, any silicon substrate architecture may be utilized. It should be understood that the internal configuration of each integrated circuit 34 is conventional, and may include standard transistor switching circuitry or other suitable solid state switching circuitry known in the art. The switching circuitry within each integrated circuit 34 is operable in response to a preselected set of logic signals to switch an excitation voltage present at the input to the integrated circuit to selected control electrodes forming the output of the integrated circuit.

As seen in FIGS. 1 and 3, each integrated circuit 34 formed within the interior portion 36 of substrate layer 12 preferably lies along a longitudinal axis represented by the dotted line 38 and is spaced from both the lateral edge surface 30 and lateral edge surface 40 of substrate layer 12.

Any semiconductor processing technique known in the art may be utilized to form the plurality of control electrodes 24 on the top surface 26 of silicon substrate layer 12. Each control electrode 24 has a connecting end portion 42 electrically connected with a pad 44 of integrated circuit 34. Pad 44 is connected in a well known manner with the switching circuitry within an integrated circuit 34. Alternatively, each of the control electrodes 24 may be integrated with the switching circuitry architecture. Each control electrode 24 also includes a main body portion 46, and the plurality of control electrodes 24 main body portions 46 are preferably parallel with each other to provide that the end portions 22 of the control electrodes 24 are also substantially parallel with each other at lateral edge 30 of substrate layer 12.

As seen in FIG. 1, the plurality of control electrodes end portions, the common electrode, and dielectric and phosphor layers of TFEL structure 11 define a plurality of individual pixels 48. With the plurality of control electrodes 24 end portions 22 substantially parallel with and spaced from each other on substrate layer 12 top surface 26 to define a gap or space 50 between adjacent control electrodes end portions, suitable techniques such as ion milling of the TFEL structure at the area of each gap 50 may be utilized to form a plurality of parallel recessed portions 51 in structure 11 thereby further defining the plurality of pixels 48. Other techniques such as wet or dry etching or delineation techniques may be utilized to permit the TFEL element to be cut or formed at the area of each gap 50 to the required dimensions without causing any impairment to the behavioral characteristics of the electroluminescent structure generally, or the phosphor material in particular.

As described, one or more integrated circuits may be formed in the interior portion of a sheet of silicon substrate material with the output leads of each integrated circuit extending to a lateral edge surface of the substrate layer. The integrated circuit output leads form control electrodes, and the end portions of the control electrodes adjacent the lateral edge surface of the substrate layer have a generally laminar TFEL structure disposed thereon.

Referring again to FIGS. 1 and 3, it can be seen that each integrated circuit 34 formed in the interior portion 36 of silicon substrate 12 includes a logic signal input 52 and an excitation voltage input 54. As previously described, each integrated circuit 34 is fabricated utilizing known integrated circuit fabrication techniques to form a power-switching network which is operable to provide an excitation voltage delivered from a voltage source 56 to selected control electrodes 24 in response to preselected logic signals provided to the integrated circuit from a logic signal device 58. Stated in another manner, logic signals provided to integrated circuit 34 at logic signal input 52 from logic signal device 58 are operable via the switching circuitry within integrated circuit 34 to connect excitation voltage source 56 with selected control electrodes 24. Since excitation voltage source 56 is connected between each integrated circuit and a common reference potential, and common electrode layer 20 is also connected to common reference potential (represented by the numeral 60), the excitation voltage impressed across a control electrode and the common electrode layer of a selected pixel 48 excites the electroluminescent phosphor of the pixel to produce a light signal emitted at pixel light-emitting face 28.

It should be understood that TFEL structure 11, integrated circuit 34 and the plurality of control electrodes 24 illustrated in FIGS. 1 and 3 are greatly enlarged for the sake of clarity. Actually, the distance between the lateral edge surfaces 30 and 40 of substrate layer 12 may fall within a range of between 1 and 2 inches. TFEL structure 11 disposed on top surface 26 of substrate layer 12 extends approximately 2 microns above top surface 26, and extends from lateral edge surface 30 towards longitudinal axis 38 over a distance typically ranging between 1 to 4 millimeters.

As previously described, TFEL structure 11 includes a light-emitting face 28 which lies along the lateral edge surface 30 of silicon substrate layer 12. Light-emitting edge face 28 is delineated to form a plurality of individual pixels 48 each consisting of a control electrode end portion 22, first dielectric layer 16, phosphor layer 14, second dielectric layer 18 and common electrode layer 20. TFEL structure 11 also includes a rear edge face 32 which is a light reflecting face. By light reflecting it is meant that at least 80% of the light radiated within the phosphor layer of each pixel which travels in a direction towards rear edge face 32 is reflected at rear edge face 32 in a direction towards light-emitting edge face 28. Rear edge face 32 may be made a light-reflecting face by placing a coating of light reflecting, nonconductive material (not shown) thereon. However, the preferred construction for providing a light reflecting rear edge face 32 is illustrated in FIG. 5.

Figure 5:
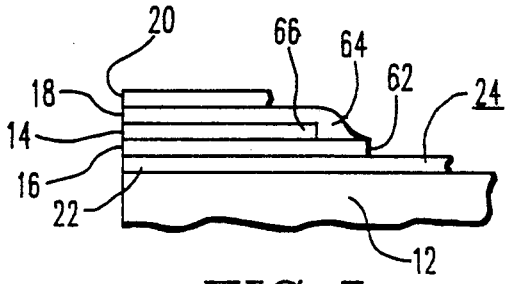
FIG. 5 is a partial fragmentary view in side elevation of a thin film electroluminescent structure positioned on a substrate material, illustrating the preferred configuration of the dielectric layers of the thin film structure.

Referring to FIG. 5, there is illustrated phosphor layer 14 disposed between first and second dielectric layers 16 and 18. Common electrode layer 20 is disposed on second dielectric layer 18, and the laminar arrangement of first and second dielectric layers 16, 18, phosphor layer 14 and common electrode layer 20 is disposed on control electrodes 24 end portions 22 (one shown). As seen in FIG. 5, first and second dielectric layers 16, 18 include end portions 62, 64 respectively, which extend beyond the end portion 66 of phosphor layer 14 and are formed to enclose the end portion 66 of phosphor layer 14. With this arrangement, at least 80% of the light radiated within the phosphor layer of a selected pixel which travels in a direction towards the end portion of the phosphor layer is reflected by the end portions 62, 64 of first and second dielectric layers 16, 18 in a general direction towards light-emitting face 28.

What has been described herein is a thin film electroluminescent line array or edge emitter assembly which utilizes light emitted by the edge of the assembly to provide a high brightness, narrow light source. The assembly includes a thin film electroluminescent edge emitter structure which is disposed on control electrodes etched in a substrate layer and connected to the output of one or more integrated circuits formed in the substrate layer. Preselected logic signals provided to the integrated circuit from an external source control the application of an excitation voltage to selected pixels of the structure to produce a high brightness light signal emitted at the light-emitting face of each pixel. Utilizing a plurality of integrated circuits formed in the silicon substrate layer to control the application of an excitation voltage to the various pixels in the thin film structure disposed on the substrate layer eliminates the need for external excitation voltage control source and provides a thin film electroluminescent edge emitter assembly which is both inexpensive and easy to manufacture.

Although the present invention has been described in terms of what are at present believe to be its preferred embodiments, it will be apparent to those skilled in the art that various changes may be made without departing from the scope of the invention. It is therefore intended that the appended claims cover such changes.

We claim:

1. A thin film electroluminescent edge emitter assembly comprising:

(a) a substrate having a configuration to define a top surface and at least one lateral edge surface;

(b) at least one integrated circuit being composed of semiconductor material and formed within an interior portion of said substrate, said integrated circuit having a logic signal input, an excitation voltage input, a plurality of output leads, and internal means for providing an excitation voltage from said excitation voltage input to selected output leads in response to preselected logic signals provided to said internal means at said logic signal input; and (c) a plurality of pixels each having a light-emitting face at said substrate lateral edge surface and an opposite, light-reflecting face, said pixels including a plurality of laterally-spaced control electrodes having end portions extending to and terminating substantially at said substrate lateral edge surface, each control electrode connected to one of said output leads of said integrated circuit and disposed either upon said top surface of said substrate or within the interior thereof, a first dielectric layer disposed above said top surface of said substrate on said plurality of control electrodes at said control electrodes end portions, a second dielectric layer spaced above said first dielectric layer and said control electrodes end portions, a phosphor layer interposed between said first and second dielectric layers, and a common electrode layer above and disposed on said second dielectric layer;

(d) selected ones of said pixels being responsive to said excitation voltage provided to said selected control electrodes end portions thereof from said integrated circuit via said output leads thereof to radiate a light signal emitted at said selected pixels light-emitting faces.

2. The thin film electroluminescent edge emitter assembly of claim 1 in which:

said substrate is formed from a layer of silicon material having a central portion bounded by a pair of opposing lateral edge surfaces; and said central portion includes a plurality of integrated circuits formed therein.

3. The thin film electroluminescent edge emitter assembly of claim 2 in which:

said plurality of control electrodes end portions terminate substantially at the same lateral edge surface of said substrate.

4. The thin film electroluminescent edge emitter assembly of claim 2 in which:

said silicon substrate is an elongated, sheet-like member having a longitudinal axis extending through said central portion with said lateral edge surfaces substantially parallel to said longitudinal axis; and said plurality of integrated circuits are formed in said substrate along said longitudinal axis to provide that said plurality of integrated circuits are spaced a preselected distance from each of said lateral edge surfaces.

5. The thin film electroluminescent edge emitter assembly of claim 2 in which:

each of said plurality of control electrodes has an overall length sufficient to extend between an integrated circuit formed in said central portion and one of said lateral edge surfaces;

said end portion of each said control electrode has a length substantially less than said overall length; and said first dielectric layer, phosphor layer, second dielectric layer and common electrode layer are disposed on said plurality of control electrodes end portions to provide that said plurality of pixels defined thereby are spaced from said plurality of integrated circuits.

6. The thin film electroluminescent edge emitter assembly of claim 1 in which:

said end portions of said plurality of control electrodes are spaced from each other along said substrate lateral edge surface to define a gap between adjacent end portions;

said first dielectric layer, phosphor layer, second dielectric layer and common electrode layer are disposed in generally laminar fashion on said spaced apart control electrodes end portions thereby defining said plurality of pixels; and said first dielectric layer, phosphor layer, second dielectric layer and common electrode layer are each grooved at the area of said gap between adjacent control electrodes to provide a recessed portion between adjacent pixels at said pixels light-emitting faces.

7. The thin film electroluminescent edge emitter assembly of claim 1 in which:

said phosphor layer is enclosed by said first and second dielectric layers at said pixel light-reflecting face.

8. The thin film electroluminescent edge emitter assembly of claim 1 in which:

said light-reflecting face is coated with a layer of non-conductive reflective material.

9. The thin film electroluminescent edge emitter apparatus of claim 1 in which:

an excitation voltage source is connected between said integrated circuit excitation voltage input and a common reference potential;

said common electrode layer is connected to said common reference potential;

said logic signals provided to said integrated circuit logic signal input operate on said means internal to said integrated circuit to connect said excitation voltage source between said selected control electrodes and said common electrode layer; and said excitation voltage provided from said source is impressed across said selected control electrodes and common electrode layer to cause said selected pixels associated with said selected control electrodes to radiate a light signal emitted at said selected pixels light-emitting faces.

10. A method for forming a thin film electroluminescent edge emitter assembly comprising the steps of:

providing a substrate having a configuration to define a top surface and at least one lateral edge surface;

forming in said substrate at least one integrated circuit having a logic signal input, an excitation voltage input, a plurality of output leads, and forming means internal to said integrated circuit and being operable to provide an excitation voltage from said excitation voltage input to selected output leads in response to preselected logic signals received at said logic signal input;

disposing a laminar arrangement formed from a plurality of control electrodes, a first dielectric layer disposed on and overlying said control electrodes, a second dielectric layer, a phosphor layer interposed between said first and second dielectric layers, and a common electrode layer disposed on said said second dielectric layer, said laminar arrangement defining a plurality of pixels each having a light-emitting face at said end portion, said control electrodes being disposed either upon said top surface of said substrate or within the interior thereof; and providing an excitation voltage to selected control electrodes via said output leads to radiate within pixels associated with said selected control electrodes a light signal emitted at said associated pixels light-emitting faces.

11. The method of claim 10, including the steps of:

forming said integrated circuit in a central portion of said substrate, said central portion being bounded by a pair of opposing lateral edge surfaces;

extending said control electrodes from said integrated circuit to one of said substrate lateral edge surfaces; and disposing said laminar arrangement on said control electrodes end portions so that said plurality of pixels light-emitting faces is aligned with said one lateral edge surface.

* * * * *